US005182907A

United States Patent [19]

Kuroda et al.

[11] Patent Number: 5,182,907

[45] Date of Patent: Feb. 2, 1993

[54] SYSTEM FOR MONITORING PERFORMANCE OF HC SENSORS FOR INTERNAL COMBUSTION ENGINES

[75] Inventors: Shigetaka Kuroda; Yoichi Iwata, both of Wako, Japan

[73] Assignee: Honda Giken Kogyo Kabushiki Kaisha, Tokyo, Japan

[21] Appl. No.: 755,088

[22] Filed: Sep. 5, 1991

[30] Foreign Application Priority Data

Sep. 5, 1990 [JP] Japan ..... 2-236851

[51] Int. Cl.[5] ..... F02D 41/14

[52] U.S. Cl. ..... 60/276; 60/277; 73/118.1; 123/674; 123/688; 123/691; 123/693

[58] Field of Search ..... 60/274, 276, 277; 123/440, 489, 688, 691, 674, 693; 73/118.1

[56] References Cited

U.S. PATENT DOCUMENTS

| | | | |
|---|---|---|---|
| 4,789,939 | 12/1988 | Hamburg | 123/674 |
| 4,819,427 | 4/1989 | Nagai | 60/276 |
| 4,941,318 | 7/1990 | Matsuoka | 60/276 |
| 5,077,970 | 1/1992 | Hamburg | 60/274 |

FOREIGN PATENT DOCUMENTS

| | | | |
|---|---|---|---|
| 50-47228 | 4/1975 | Japan . | |
| 12855 | 1/1988 | Japan | 123/693 |
| 63-189638 | 8/1988 | Japan . | |
| 1-93051 | 8/1989 | Japan | 123/688 |

*Primary Examiner*—Douglas Hart
*Attorney, Agent, or Firm*—Lyon & Lyon

[57] ABSTRACT

A system which monitors the performance of at least one HC sensor arranged in an exhaust passage of and internal combustion engine. According to a first aspect of the invention, a value of output from the at least one HC sensor is stored, which is assumed when the fuel supply to the engine is cut off, and a value of output from the at least one HC sensor is corrected by the stored value. According to a second aspect of the invention, the value of output from the at least one HC sensor assumed when the fuel supply to the engine is cut off is compared with a predetermined value, and if the former exceeds the latter, it is judged that there is abnormality in the at least one HC sensor.

7 Claims, 7 Drawing Sheets

FUEL INJECTION VALVE
6
2
3
3'
4
θTH
7
8
PBA
INTERNAL COMBUSTION ENGINE
1
CYL
11
Ne
10
Tw
19
12
O2
14
HC
16
THREE-WAY CATALYST (CAT)
13
TCAT
15
HC
17
5a
5b
5c
5d
INPUT CIRCUIT
C P U
MEMORY MEANS
OUTPUT CIRCUIT
ECU
5
18

SYSTEM FOR MONITORING PERFORMANCE OF HC SENSORS FOR INTERNAL COMBUSTION ENGINES

BACKGROUND OF THE INVENTION

This invention relates to a system for monitoring the performance of HC sensors arranged in the exhaust passage of an internal combustion engine for detecting concentration of hydrocarbons (HC) in exhaust gases emitted from the engine.

Conventionally, a system has been proposed by Japanese Provisional Patent Publication (Kokai) No. 50-47228, which uses an HC sensor arranged in an exhaust passage of an internal combustion engine, to control in response to output from the HC sensor, an amount of fuel and an amount of air supplied to the engine such that the concentration of noxious components (HC) in exhaust gases decreases to the minimum value.

Further, a system for detecting deterioration of a three-way catalyst of an internal combustion engine has been proposed by the present assignee e.g. by U.S. Ser. No. 07 717,247 filed Jun. 18, 1991. The proposed system uses two HC sensors arranged in an exhaust passage of an internal combustion engine respectively at locations upstream and downstream of a three-way catalyst arranged in the exhaust passage, to determine whether the three-way catalyst is deteriorated or not, by comparing outputs from the HC sensors.

However, in general, the performance of HC sensors such as an output characteristic thereof deteriorates due to aging etc. If various controls are carried out based on the output from an HC sensor which is thus degraded in performance, such controls cannot attain required control accuracy.

More specifically, in the above described two systems, if the output from the HC sensor which does not accurately reflect the concentration of HC in exhaust gases is used, accurate air-fuel ratio control cannot be effected, or accurate detection of deterioration of the three-way catalyst cannot be effected.

SUMMARY OF THE INVENTION

It is an object of the invention to provide a system for monitoring the performance of at least one HC sensor of an internal combustion engine, in order to prevent degradation in accuracy of a control based upon the output from the at least one HC sensor.

To attain the object, the invention provides a system for monitoring the performance of at least one HC sensor provided in an internal combustion engine having an exhaust passage, the at least one HC sensor being arranged in the exhaust passage for detecting concentration of hydrocarbons present in exhaust gases from the engine.

According to a first aspect of the invention, the system is characterized by comprising:

memory means for storing a value of output from the at least one HC sensor assumed when fuel supply to the engine is cut off; and correcting means for correcting a value of output from the at least one HC sensor by the value of output from the at least one HC sensor stored by the memory means to obtain a corrected value of the value of output from the at least one HC sensor.

Preferably, the system includes comparison means for comparing the value of output from the at least one HC sensor assumed when fuel supply to the engine is cut off, with a predetermined value, and the memory means stores the value of output from the at least one HC sensor assumed when fuel supply to the engine is cut off, if it does not exceed the predetermined value.

More preferably, the predetermined value is set such that it cannot be exceeded by the value of output from the at least one HC sensor when fuel supply to the engine is cut off, if the at least one HC sensor is normally functioning.

According to a second aspect of the invention, the system is characterized by comprising:

comparison means for comparing a value of output from the at least one HC sensor assumed when fuel supply to the engine is cut off, with a predetermined value; and judging means for judging that there is abnormality in the at least one HC sensor if the value of output from the at least one HC sensor assumed when fuel supply to the engine is cut off, exceeds the predetermined value.

Preferably, the predetermined value is set such that it cannot be exceeded by the value of output from the at least one HC sensor when fuel supply to the engine is cut off, if the at least one HC sensor is normally functioning.

Also preferably, the judging means judges that there is abnormality in the at least one HC sensor, if the value of output from the at least one HC sensor assumed when fuel supply to the engine is cut off, has continued to exceed the predetermined value over a predetermined time period.

The above and other objects, features, and advantages of the invention will become more apparent from the ensuing detailed description taken in conjunction with the accompanying drawings.

DETAILED DESCRIPTION

The invention will now be described in detail with reference to the drawings showing an embodiment thereof.

Figure 1:
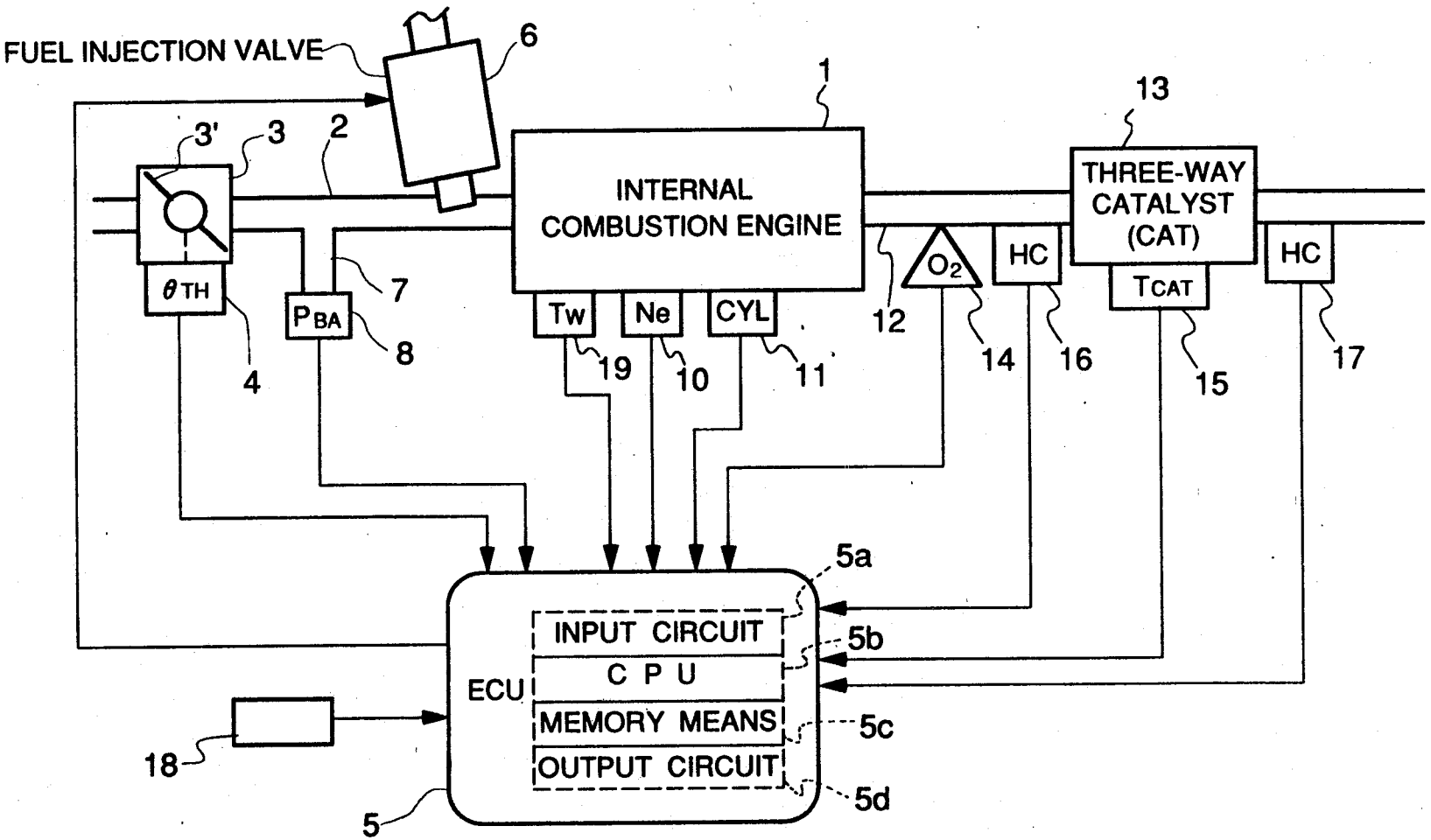
FIG. 1 is a schematic diagram showing the whole arrangement of a fuel supply control system of an internal combustion engine including a system for monitoring the performance of HC sensors according to the invention.

Referring first to FIG. 1, there is shown the whole arrangement of a fuel supply control system for an internal combustion engine, including a system for monitoring the performance of HC sensors according to the invention. In the figure, reference numeral 1 designates an internal combustion engine for automotive vehicles. Connected to the cylinder block of the engine 1 is an intake pipe 2 across which is arranged a throttle body 3 accommodating a throttle valve 3' therein. A throttle valve opening ($\theta_{TH}$) sensor 4 is connected to the throttle valve 3' for generating an electric signal indicative of the sensed throttle valve opening and supplying same to an electronic control unit (hereinafter called "the ECU") 5.

Fuel injection valves 6, only one of which is shown, are inserted into the interior of the intake pipe 2 at locations intermediate between the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

On the other hand, an intake pipe absolute pressure ($P_{BA}$) sensor 8 is provided in communication with the interior of the intake pipe 2 through a conduit 7 at a location immediately downstream of the throttle valve 3' for supplying an electric signal indicative of the sensed absolute pressure within the intake pipe 2 to the ECU 5.

An engine coolant temperature ($T_W$) sensor 9, which may be formed of a thermistor or the like, is mounted in the cylinder block of the engine 1, for supplying an electric signal indicative of the sensed engine coolant temperature $T_W$ to the ECU 5. An engine rotational speed (Ne) sensor 10 and a cylinder-discriminating (CYL) sensor 11 are arranged in facing relation to a camshaft or a crankshaft of the engine 1, neither of which is shown. The engine rotational speed sensor 10 generates a pulse as a TDC signal pulse at each of predetermined crank angles whenever the crankshaft rotates through 180 degrees, while the cylinder-discriminating sensor 11 generates a pulse at a predetermined crank angle of a particular cylinder of the engine, both of the pulses being supplied to the ECU 5. The ECU 5 calculates an engine rotational speed Ne based on the TDC signal pulses.

A three-way catalyst (CAT) 13 is arranged within an exhaust pipe 12 connected to the cylinder block of the engine 1 for purifying noxious components such as HC, CO, and NOx. An $O_2$ sensor 14 as an oxygen concentration sensor is mounted in the exhaust pipe 12 at a location intermediate between the three-way catalyst 13 and the engine 1, for sensing the concentration of oxygen present in exhaust gases emitted therefrom and supplying an electric signal in accordance with an output value thereof to the ECU 5. Further, a catalyst temperature ($T_{CAT}$) sensor 15 is mounted on the three-way catalyst 13 for detecting the temperature of same and supplying a signal indicative of the detected catalyst temperature $T_{CAT}$ to the ECU 5.

Further, HC sensors 16, 17 are arranged in the exhaust pipe 12 at locations upstream and downstream of the three-way catalyst 13, respectively, for detecting the concentration of hydrocarbons (HC) present in exhaust gases, and supplying signals having output voltages corresponding to the detected concentration of hydrocarbons to the ECU 5. The HC sensors 16, 17 each have a characteristic that as the concentration of hydrocarbons in exhaust gases increases, its output voltage increases.

The ECU 5 detects deterioration of the three-way catalyst 13 by comparing between signals supplied from the HC sensor (hereinafter referred to as "the pre-catalyst HC sensor") 16 upstream of the three-way catalyst 13 and the HC sensor (hereinafter referred to as "the post-catalyst HC sensor") 17 downstream of same, respectively. The manner of detection of deterioration of the three-way catalyst 13 is disclosed in U.S. Ser. No. 07 717,247, referred to hereinbefore.

Connected to the ECU 5 is an indicator 18 formed of four LED's (light emitting diodes) for raising an alarm when abnormality of the HC sensors 16, 17 has been detected in a manner described in detail hereinafter.

The ECU 5 comprises an input circuit **5*a* having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") 5*b* for executing a performance monitoring program described hereinafter etc., memory means 5*c* storing various operational programs which are executed in the CPU 5*b*, and a Ti map, a $T_{OUT}-V_{HCFLVL}$ table, and a $T_{OUT}-V_{HCFLVL}$ table, described hereinafter, and for storing results of calculations therefrom, etc., and an output circuit 5*d* which outputs driving signals to the fuel injection valves 6, the indicator 18**, etc.

In addition, the ECU 5 forms memory means, correcting means, comparison means, and judging means, recited in the appended claims.

The CPU **5*b* operates in response to output signals from various sensors to determine operating conditions in which the engine 1 is operating, such as an air-fuel ratio feedback control region in which the fuel supply is controlled in response to the detected oxygen concentration in the exhaust gases, and open-loop control regions including a fuel cut region, and calculates, based upon the determined operating conditions, the valve opening period or fuel injection period $T_{OUT}$ over which the fuel injection valves 6 are to be opened, by the use of the following equation (1) in synchronism with inputting of TDC signal pulses to the ECU 5**:

$$T_{OUT}=T_i\times K_{02}\times K_1+K_2 \quad (1)$$

where $T_i$ represents a basic value of the fuel injection period $T_{OUT}$ of the fuel injection valves 6, which is read from a Ti map set in accordance with the engine rotational speed Ne and the intake pipe absolute pressure $P_{BA}$.

$K_{O2}$ is an air-fuel ratio feedback control correction coefficient whose value is determined in response to the oxygen concentration in the exhaust gases detected by the $O_2$ sensor 14, during feedback control, while it is set to respective predetermined appropriate values while the engine is in predetermined operating regions (the open-loop control regions) other than the feedback control region.

The correction coefficient $KO_2$ is calculated by known proportional control using a proportional term (P-term) when an output level $V_{O2}$ of the $O_2$ sensor 14 is inverted with respect to a reference value, and by known integral control using an integral term (I-term) when the former is not inverted with respect to the latter (the manner of this calculation is disclosed e.g. in Japanese Provisional Patent Publication (Kokai) No. 63-189638).

$K_1$ and $K_2$ are other correction coefficients and correction variables, respectively, which are calculated based on various engine parameter signals to such values as to optimize characteristics of the engine such as fuel consumption and driveability depending on operating conditions of the engine.

The CPU 5*b* supplies through the output circuit 5*d*, the fuel injection valves 6 with driving signals corresponding to the calculated fuel injection period $T_{OUT}$ determined as above, over which the fuel injection valves 6 are opened.

Figure 2A:
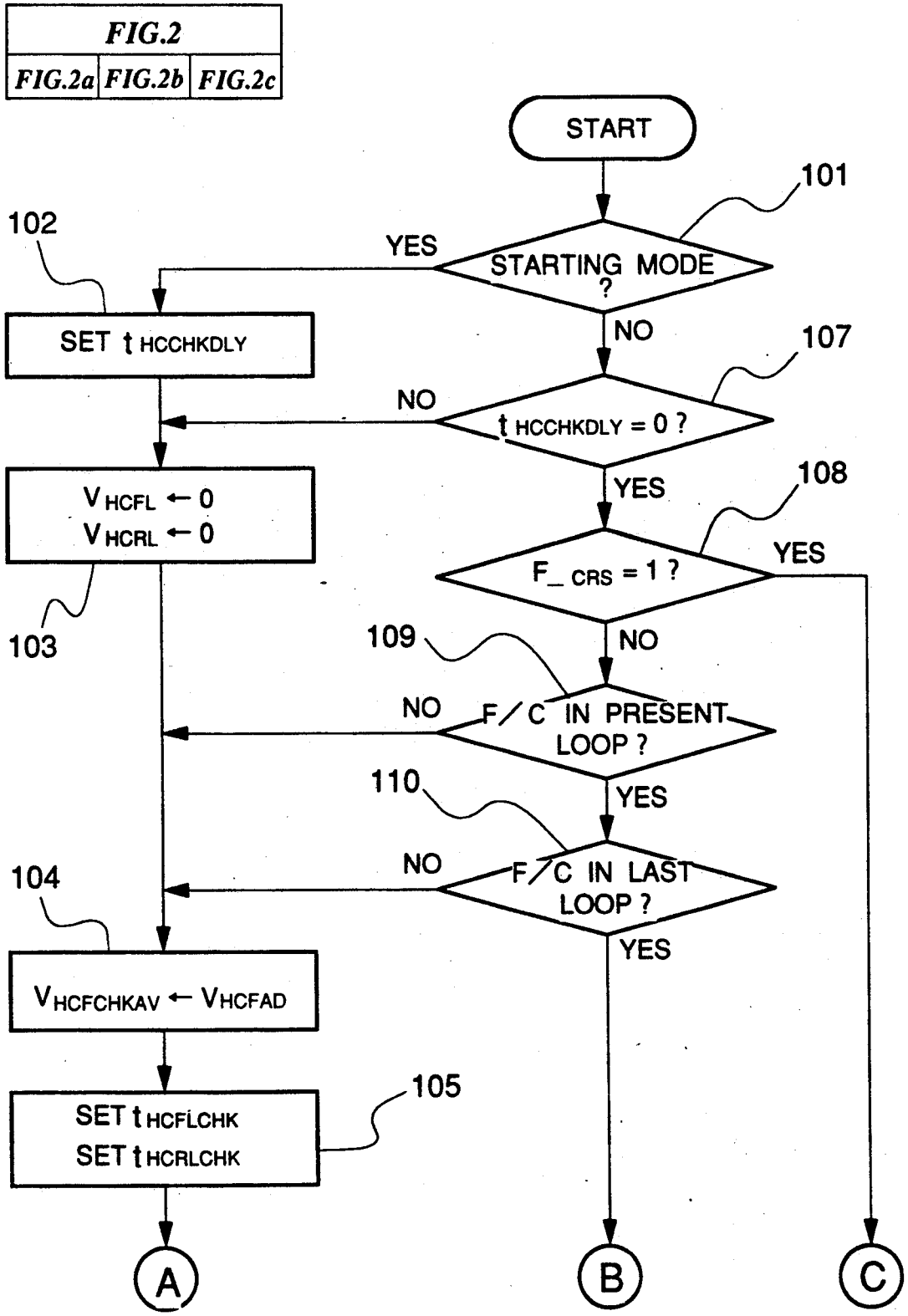
FIG. 2 is a flowchart of a program showing the manner of monitoring the performance of the HC sensors, executed by a CPU 5*b* appearing in FIG. 1.
Figure 2B:
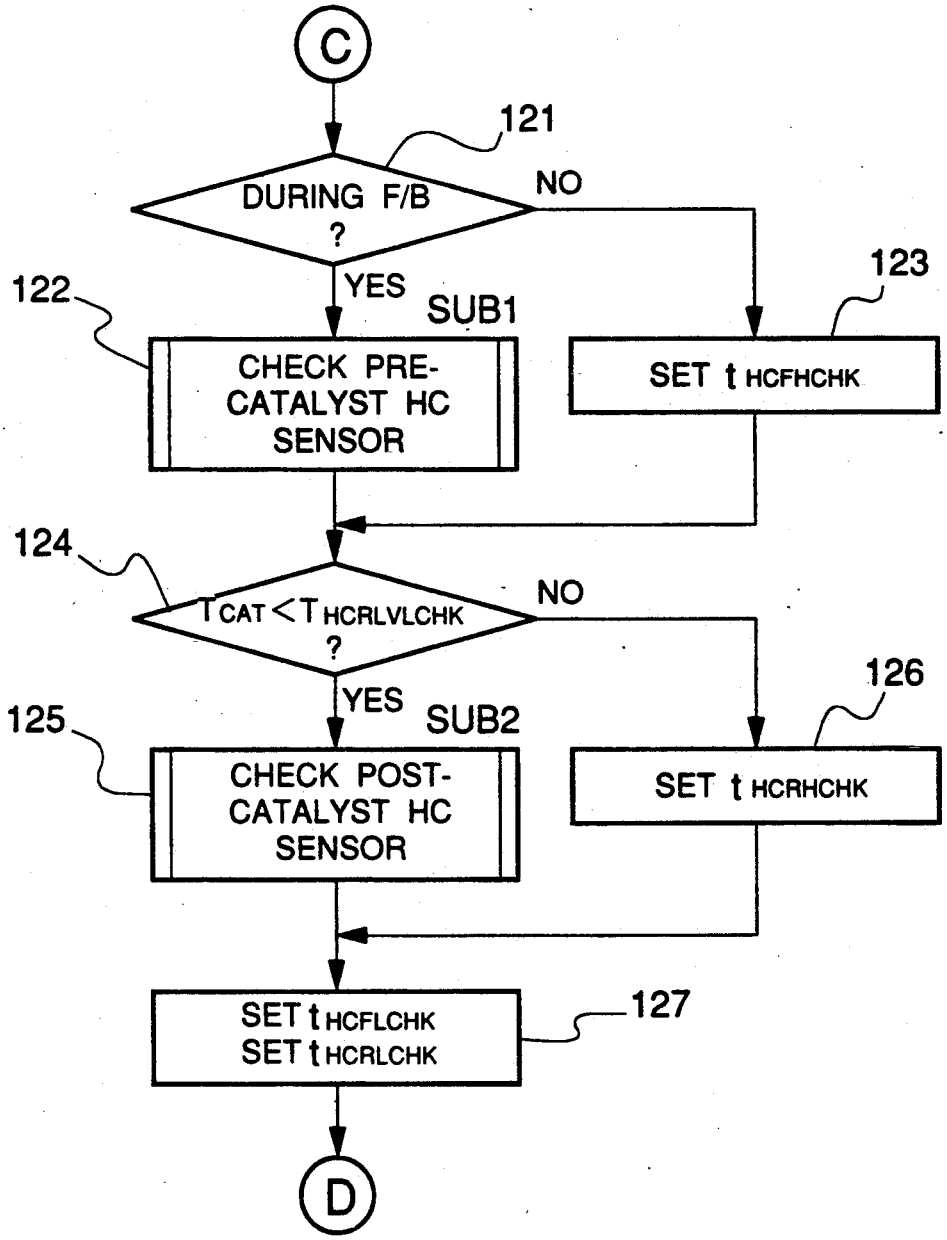
Figure 2C:
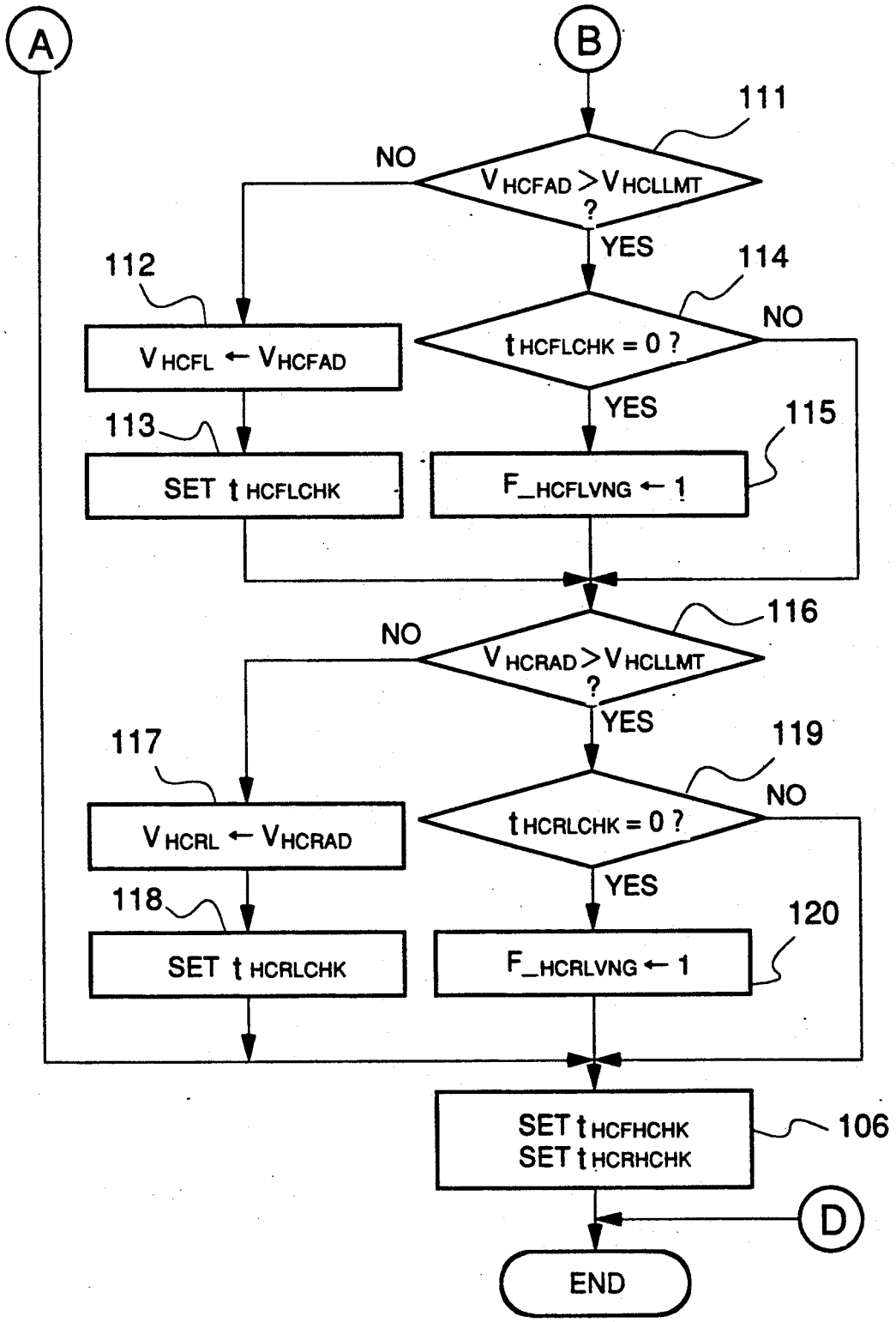

The manner of monitoring the performance of the HC sensors 16, 17, which is carried out by the CPU 5*b*, will now be described in detail with reference to FIG. 2 showing a control program therefor. The control program is executed whenever a TDC signal pulse is inputted to the ECU 5.

First, at a step 101, it is determined whether or not the engine 1 is in a starting mode. If the answer to this question is affirmative (Yes), a $t_{HCCHKDLY}$ timer formed of a down counter for measuring time elapsed after the engine 1 left the starting mode is set to a predetermined time period $t_{HCCHKDLY}$ (e.g. 60 seconds) required to elapse until the HC sensors 16, 17 are activated after being heated, and started at a step 102. Further, at a step 103, a zero point correction value $V_{HCFL}$ for the pre-catalyst HC sensor 16 and a zero point correction value $V_{HCRL}$ for the post-catalyst HC sensor 17 are initialized by setting both of them to 0. Then, at a step 104, as an initial value of a learned average value $V_{HCFCHKAV}$ of output from the pre-catalyst HC sensor, a present value $V_{HCFAD}$ (A/D converted value) of output from the HC sensor 16 is set, and at a step 105, a $t_{HCFLCHK}$ timer formed of a down counter for measuring duration of abnormality in the zero point of output from the precatalyst HC sensor 16 is set to a predetermined time period $t_{HCFLCHK}$ (e.g. 5 seconds) and started, and a $t_{HCRLCHK}$ timer formed of a down counter for measuring duration of abnormality in the zero point of output from the post-catalyst HC sensor 17 is set to a predetermined time period $t_{HCRLCHK}$ (e.g. 5 seconds) and started. At the following step 106, a $t_{HCFHCHK}$ timer formed of a down counter for measuring duration of non-zero point abnormality of the pre-catalyst HC sensor 16 (abnormality in an output range other than the zero point) is set to a predetermined time period $t_{HCFHCHK}$ (e.g. 5 seconds) and started, and a $t_{HCRHCHK}$ timer formed of a down counter for measuring duration of non-zero point abnormality of the post-catalyst HC sensor 17 is set to a predetermined time period $t_{HCRHCHK}$ (e.g. 5 seconds) and started, followed by terminating the present program.

On the other hand, if the answer to the question of the step 101 is negative (No), it is determined at a step 107 whether or not the count value of the $t_{HCCHKDLY}$ timer is equal to 0. If the answer to this question is negative (No), the program proceeds to the step 103, whereas if the answer is affirmative (Yes), i.e. if the predetermined time period $t_{HCCHKDLY}$ has elapsed after the engine 1 left the starting mode, the program proceeds to a step 108.

At the step 108, it is determined whether or not a flag $F_{-CRS}$ for indicating the state of cruising of a vehicle on which the engine 1 is installed is equal to 1. The flag $F_{-CRS}$ is set to 1 in another routine when a change in the travelling speed of the vehicle in two seconds is smaller e.g. than 0.8 km/h. The answer to the question of the step 108 is initially negative (No), so that the program proceeds to a step 109.

At the step 109, it is determined whether or not fuel cut (inhibition of fuel supply to the engine) is being carried out in the present loop. Further, at a step 110, it is determined whether or not the fuel cut was carried out in the immediately preceding loop. If either of the answers to the questions of the steps 109 and 110 is negative (No), the program proceeds to the step 104, whereas both the answers are affirmative (Yes), i.e. the fuel cut was carried out in the immediately preceding loop and is being carried out in the present loop, the program proceeds to steps 111 to 120 to set the zero point correction values $V_{HCFL}$, $V_{HCRL}$ for the HC sensors 16, 17 and detect whether or not there is abnormality in the zero points of output from same.

Specifically, at a step 111, it is determined whether or not a present value $V_{HCFAD}$ of output from the pre-catalyst HC sensor 16 is larger than an upper limit value $V_{HCLLMT}$ (e.g. 50 mV) of zero point deviation. If the answer to this question is negative (No), it is judged that there is no zero point abnormality in the pre-catalyst HC sensor 16, i.e. there is no abnormality such that when the engine undergoes fuel cut, during which the output from a normally functioning HC sensor should assume a value of 0, the HC sensor outputs voltage higher than a predetermined value, and the zero point correction value $V_{HCFL}$ for the pre-catalyst HC sensor 16 is set to the present value $V_{HCFAD}$ of output therefrom and stored in the memory means at a step 112. Then, at a step 113, the $t_{HCFLCHK}$ timer is set to the predetermined time period $t_{HCFLCHK}$ and started, followed by the program proceeding to a step 116. The zero point correction value $V_{HCFL}$ thus set is used for correcting the output value from the pre-catalyst HC sensor 16 in a step 203 appearing in FIG. 3, referred to hereinafter, as well as for correcting the output value from the sensor 16 when it is used in various controls such as air-fuel ratio control, fuel supply control, and intake air amount control.

On the other hand, if the answer to the question of the step 111 is affirmative (Yes), it is provisionally judged that there is zero point abnormality occurring in the pre-catalyst HC sensor 16, and then it is detemined at a step 114 whether or not the count value of the $t_{HCFLCHK}$ timer is equal to 0. If the answer to this question is negative (No), the program proceeds to the step 116, whereas if the answer is affirmative (Yes), i.e. if the present value $V_{HCFAD}$ of output from the pre-catalyst HC sensor 16 has continued to be larger than the upper limit value $V_{HCLLMT}$ over the predetermined time period $t_{HCFLCHK}$, it is finally judged that there is zero point abnormality occurring in the pre-catalyst HC sensor 16, and then a flag $F_{-HCFLVNG}$ for indicating zero point abnormality of the sensor 16 is set to 1 at a step 115, followed by the program proceeding to the step 116.

At the step 116, it is determined whether or not a present value (A/D converted value) $V_{HCRAD}$ of output from the post-catalyst HC sensor 17 is larger than the upper limit value $V_{HCLLMT}$ of zero point deviation. If the answer to this question is negative (No), it is judged that there is no zero point abnormality occurring in the post-catalyst HC sensor 17, and the zero point correction value $V_{HCRL}$ for the post-catalyst HC sensor 17 is set to the present value $V_{HCRAD}$ of output therefrom and stored in the memory means at a step 117. Then the $t_{HCRLCHK}$ timer is set to the predetermined time period $t_{HCRLCHK}$ and started at a step 118, followed by the program proceeding to the step 106. The zero point correction value $V_{HCRL}$ is used for correcting the output value from the post-catalyst HC sensor 17 at a step 301 appearing in FIG. 5, referred to hereinafter, as well as for correcting the output value from the sensor 17 when it is used in various controls such as air-fuel ratio control, fuel supply control, and intake air amount control.

If the answer to the question of the step 116 is affirmative (Yes), it is provisionally judged that there is possibility of occurrence of zero point abnormality in the post-catalyst HC sensor 17, and then it is determined at a step 119 whether or not the count value of the $t_{HCRLCHK}$ is equal to 0. If the answer to this question is negative (No), the program proceeds to the step 106, whereas if the answer is affirmative (Yes), i.e. if the present value $V_{HCRAD}$ of output from the post-catalyst HC sensor 17 has continued to be larger than the upper limit value $V_{HCLLMT}$ of zero point deviation over the predetermined time period $t_{HCRLCHK}$, it is finally judged that there is zero point abnormality occurring in the post-catalyst HC sensor 17, and then a flag $F_{-HCRLVNG}$ for indicating the zero point abnormality of the post-catalyst HC sensor 17 is set to 1 at a step 120, followed by the program proceeding to the step 106.

When the vehicle starts cruising and the answer to the question of the step 108 becomes affirmative (Yes), the program proceeds to a step 121, where it is determined whether or not the air-fuel ratio feedback control based on output from the $O_2$ sensor 14 is being carried out. If the answer to this question is affirmative (Yes), i.e. if the vehicle is cruising and at the same time the air-fuel ratio feedback control is being carried out, it is judged that the engine is in a condition suitable for detecting non-zero point abnormality in the pre-catalyst HC sensor 16, so that the program proceeds to a step 122 to detect non-zero point abnormality in the pre-catalyst HC sensor 16. The non-zero point abnormality is abnormality in the output value of the HC sensor assumed when fuel is being supplied to the engine 1 and hence hydrocarbons are being emitted into exhaust gases. On the other hand, if the answer to the question of the step 121 is negative (No), it is judged that engine is not in a condition suitable for detecting non-zero point abnormality, and the $t_{HCFHCHK}$ timer is set to the predetermined time period $t_{HCFHCHK}$ and started at a step 123, followed by the program proceeding to a step 124.

Figure 3:
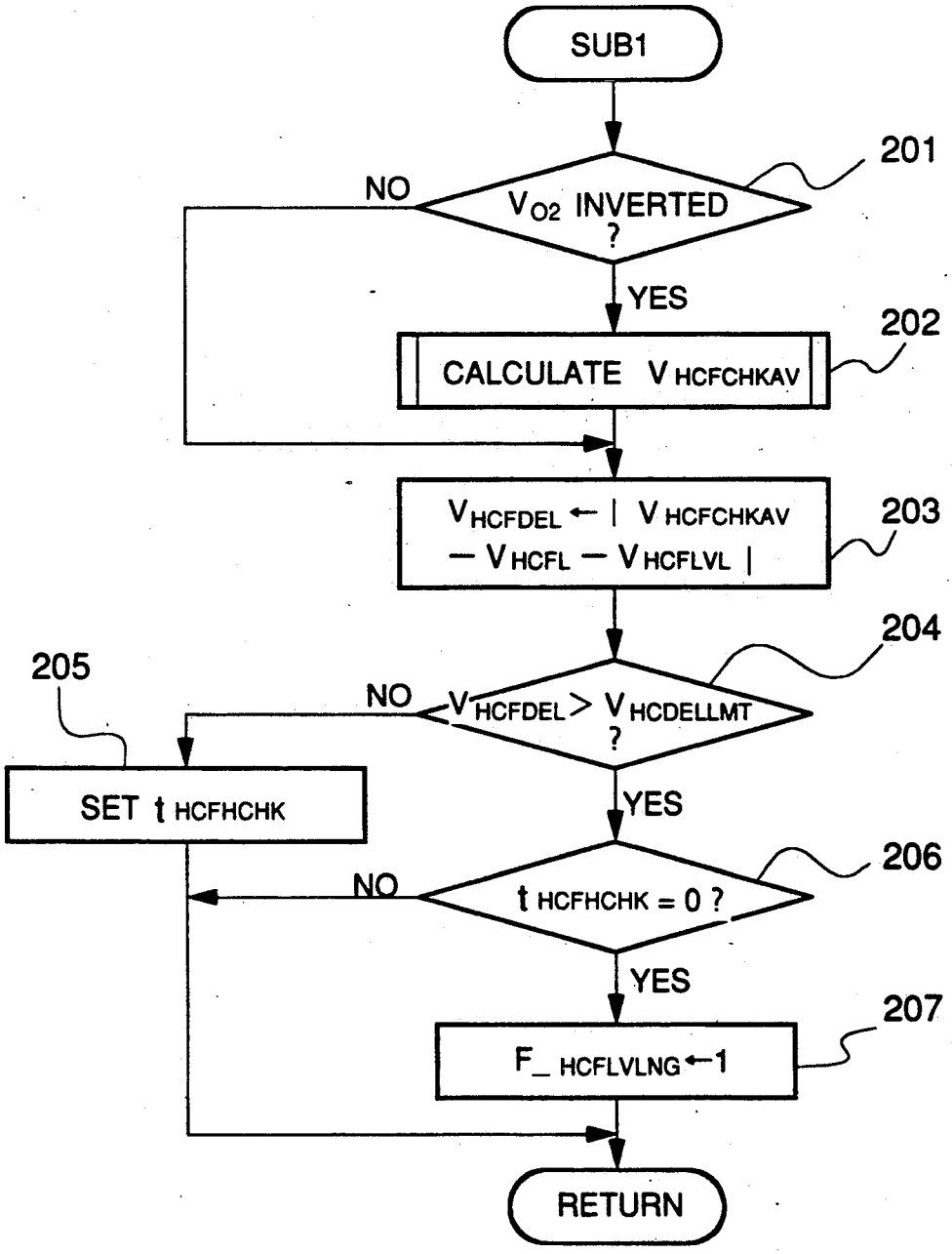
FIG. 3 is a subroutine carried out at a step 122 appearing in FIG. 2.

Details of the step 122 are shown in FIG. 3 showing a subroutine SUB1 for detection of non-zero point abnormality of the pre-catalyst HC sensor 16.

First, at a step 201, it is determined whether or not the output level $V_{02}$ of the $O_2$ sensor 14 has been inverted with respect to the reference value. If the answer to this question is affirmative (Yes), the learned average value $V_{HCFCHKAV}$ of output values $V_{HCFRAD}$ from the pre-catalyst HC sensor 16 is calculated at a step 202 by the following equation (2):

$$V_{HCFCHKAV} = V_{HCFAD} \times (C_{HCCHK}/100) + V_{HCFCHKAV} \times [(100 - C_{HCCHK})/100] \quad (2)$$

where $V_{HCFCHKAV}$ on the right-hand side is a value of the learned average value obtained up to the immediately preceding loop, using the value set at the step 104 in FIG. 2 as its initial value, and $C_{HCCHK}$ is a value selected from a value range of 1 to 100.

If the answer to the step 201 is negative (No), the program skips over the step 202 to a step 203.

At the step 203, a deviation $V_{HCFDEL}$ in the output from the pre-catalyst HC sensor 16 is calculated by the following equation (3) using the learned average value $V_{HCFCHKAV}$ obtained up to the present loop:

$$V_{HCFDEL} = |V_{HCFCHKAV} - V_{HCFL} - V_{HCFLVL}| \quad (3)$$

where $V_{HCFL}$ is the zero point correction value set at the step 112 in FIG. 2, and as can be learned from this equation, the learned average value $V_{HCFCHKAV}$ is subjected to zero point correction by subtracting the value $V_{HCFL}$ therefrom.

Figure 4:
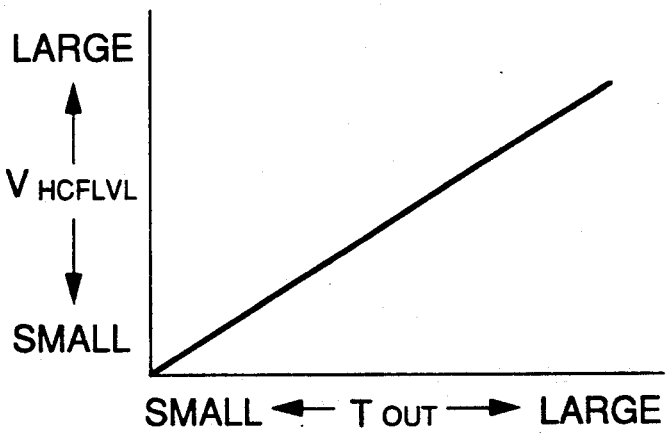
FIG. 4 shows a $T_{OUT}-V_{HCFLVL}$ table used at a step 203 appearing in FIG. 3.

$V_{HCFLVL}$ is a standard value of output from the pre-catalyst HC sensor 16 which is set in accordance with the fuel injection period $T_{OUT}$ in a $T_{OUT}-V_{HCFLVL}$ table shown in FIG. 4. The $T_{OUT}-V_{HCFLVL}$ table is set based on the fact that the concentration of hydrocarbons in exhaust gases emitted during the air-fuel ratio feedback control is commensurate to an amount of fuel supplied to the engine, and therefore it is possible to predict a standard value of output from an HC sensor from the fuel injection period $T_{OUT}$, which corresponds to the amount of fuel supplied to the engine.

Then, at a step 204, it is determined whether or not the deviation $V_{HCFDEL}$ in the output from the pre-catalyst HC sensor 16 obtained at the step 203 is larger than an upper limit value $V_{HCDELLMT}$ (e.g. 20 mV). If the answer to this question is negative (No), the $t_{HCFHCHK}$ timer is set to the predetermined time period $t_{HCFHCHK}$, and started at a step 205, followed by the program proceeding to the step 124 in FIG. 2. On the other hand, if the answer to the question of the step 204 is affirmative (Yes), it is provisionally judged that there is non-zero point abnormality occurring in the pre-catalyst HC sensor 16, and it is determined at a step 206 whether or not the count value of the $t_{HCFHCHK}$ timer is equal to 0.

If the answer to the question of the step 206 is negative (No), the program immediately proceeds to the step 124 in FIG. 2, whereas if the answer is affirmative (Yes), i.e. if the deviation $V_{HCFDEL}$ in the output from the pre-catalyst HC sensor 16 has continued to be larger than the upper limit value $V_{HCDELLMT}$ over the predetermined time period $t_{HCFHCHK}$ it is finally judged that there is non-zero point abnormality occurring in the pre-catalyst HC sensor 16, and then a flag $F_{-HCFLVLNG}$ for indicating the non-zero point abnormality of the sensor 16 is set to 1 at a step 207, followed by the program proceeding to the step 124 in FIG. 2.

Referring again to FIG. 2, at the step 124, it is determined whether or not the catalyst temperature $T_{CAT}$ is lower than a predetermined value $T_{HCRLVLCHK}$ (e.g. 200° C.). The predetermined value $T_{HCRLVLCHK}$ is set at a lower limit value of a catalyst temperature range within which the three-way catalyst can exhibit normal purifying efficiency if it is normally functioning. Therefore, the step 124 is provided for determining whether or not the three-way catalyst has lost its normal purifying ability and hence hydrocarbons of high concentration are supplied to the post-catalyst HC sensor 17.

If the answer to the question of the step 124 is affirmative (Yes), i.e. if the vehicle is cruising and at the same time the catalyst temperature $T_{CAT}$ is lower than the predetermined value $T_{HCRLVLCHK}$, it is judged that the engine is in a condition suitable for detecting non-zero point abnormality in the post-catalyst HC sensor 17, and the program proceeds to a step 125 to detect non-zero point abnormality in the post-catalyst HC sensor 17. On the other hand, if the answer to the question of the step 124 is negative (No), it is judged that the engine is not in a condition suitable for detecting non-zero point abnormality, and the $t_{HCRHCHK}$ timer is set to the predetermined time period $t_{HCRHCHK}$ and started at a step 126, followed by the program proceeding to a step 127.

Figure 5:
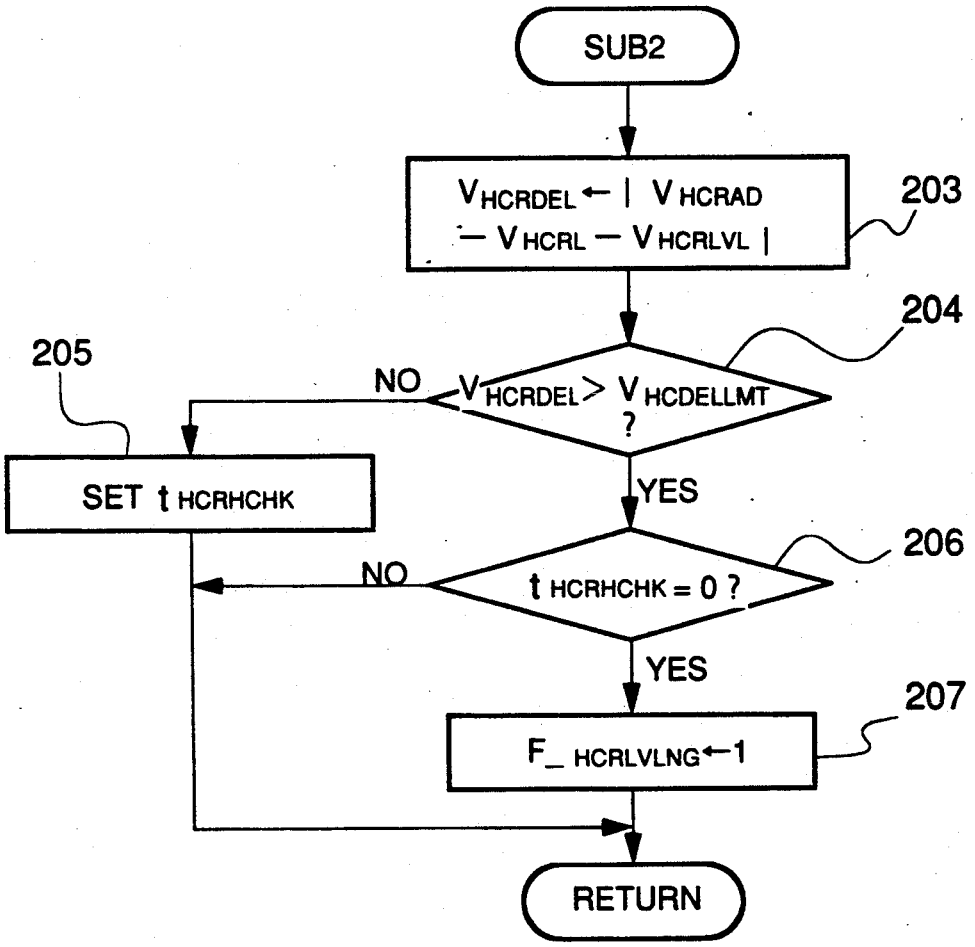
FIG. 5 is a flowchart of a subroutine carried out at a step 125 appearing in FIG. 2.

Details of the step 125 are shown in FIG. 5 showing a subroutine SUB 2 for detection of non-zero point abnormality of the post-catalyst HC sensor 17.

First, at a step 301, a deviation $V_{HCRDEL}$ in the output from the post-catalyst HC sensor 17 is calculated by the following equation (4) using the present value $V_{HCRAD}$ of output from the post-catalyst HC sensor 17:

$$V_{HCRDEL} = |V_{HCRAD} - V_{HCRL} - V_{HCRLVL}| \quad (4)$$

where $V_{HCRL}$ is the zero point correction value set at the step 117 in FIG. 2, and as can be learned from this equation, the present value $V_{HCRAD}$ is subjected to zero point correction by subtracting the value $V_{HCRL}$ therefrom.

Figure 6:
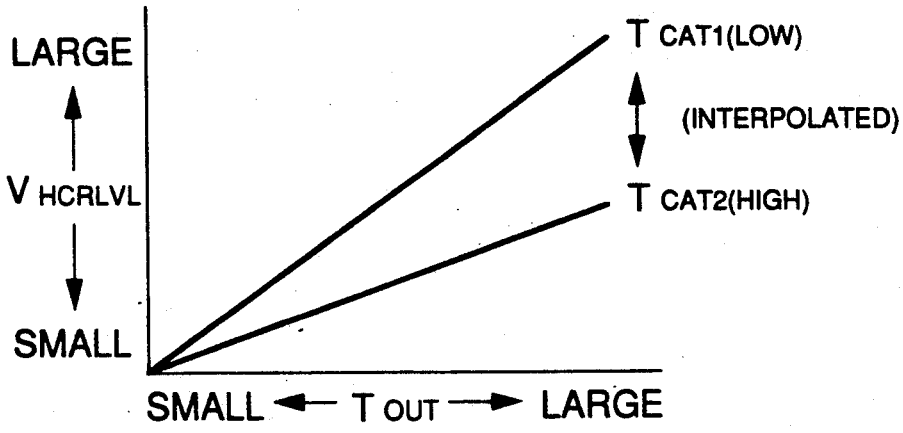
FIG. 6 shows a $T_{OUT}-V_{HCRLVL}$ table used at a step 301 appearing in FIG. 5.

$V_{HCRLVL}$ is a standard value of output from the post-catalyst HC sensor 17 which is set in accordance with the fuel injection period $T_{OUT}$ and the catalyst temperature $T_{CAT}$ in a $T_{OUT}-V_{HCRLVL}$ table shown in FIG. 6. The standard value $V_{HCRLVL}$ is set such that it increases with an increase in the fuel injection period $T_{OUT}$, and it decreases with an increase in the catalyst temperature $T_{CAT}$ insofar as the $T_{OUT}$ value is the same. When the catalyst temperature $T_{CAT}$ lies between a value $T_{CAT1}$ and a value $T_{CAT2}$ ($>T_{CAT1}$), the standard value $V_{HCRLVL}$ is calculated by interpolation.

As noted above, in detection of non-zero point abnormality in the post-catalyst HC sensor 17, the calculation of a learned average value of output from the sensor is not carried out as in the case of detection of non-zero point abnormality in the pre-catalyst HC sensor 16 (the step 202 in FIG. 3). This is because the concentration of HC has already been averaged by the three-way catalyst 13, and this makes unnecessary the use of the learned average value in the case of the post-catalyst HC sensor 17 arranged downstream of the catalyst 13. However, the learned average value may be calculated with respect to the post-catalyst HC sensor 17 as well to obtain the output deviation $V_{HCRDEL}$ thereof.

Then, at a step 302, it is determined whether or not the output deviation $V_{HCRDEL}$ of the post-catalyst HC sensor 17 obtained at the step 301 is larger than the upper limit value $V_{HCDELLMT}$. If the answer to this question is negative (No), the $t_{HCRHCHK}$ timer is set to the predetermined time period $t_{HCRHCHK}$, and started at a step 303, followed by the program proceeding to the step 127 in FIG. 2. On the other hand, if the answer to the question of the step 302 is affirmative (Yes), it is provisionally judged that there is non-zero point abnormality in the post-catalyst HC sensor 17, and it is determined at a step 304 whether or not the count value of the $t_{HCRHCHK}$ timer is equal to 0.

If the answer to the question of the step 304 is negative (No), the program immediately proceeds to the step 127 in FIG. 2, whereas if the answer is affirmative (Yes), i.e. if the deviation $V_{HCRDEL}$ in output from the post-catalyst HC sensor has continued to be larger than the upper limit value $V_{HCDELLMT}$ over the predetermined time period $t_{HCRHCHK}$, it is finally judged that there is non-zero point abnormality occurring in the post-catalyst HC sensor 17, and then a flag $F_{-HCRLVLNG}$ for indicating the non-zero point abnormality of the sensor 17 is set to 1 at a step 305, followed by the program proceeding to the step 127 in FIG. 2.

Referring again to FIG. 2, at the step 127, the $t_{HCFLCHK}$ timer and the $t_{HCRLCHK}$ timer are set to the respective predetermined time periods $t_{HCFLCHK}$ and $t_{HCRLCHK}$, and started, respectively, followed by terminating the present program.

In another control program, not shown, it is determined whether or not the flags $F_{-HCFLVNG}$ and $F_{-HCFLVLNG}$ for respectively indicating the zero point abnormality and the non-zero point abnormality in the pre-catalyst HC sensor 16, and the flags $F_{-HCRLVNG}$ and $F_{-HCRLVLNG}$ for respectively indicating the zero point abnormality and the non-zero point abnormality in the post-catalyst HC sensor 17 are each equal to 1. If any of the flags assumes a value of 1, a driving signal is supplied to the indicator 18 such that an LED corresponding to the flag assuming a value of 1 is lighted. Thus, the driver or a car mechanic can be informed of abnormality of the HC sensors.

Although in the above described embodiment, the system for monitoring the performance of HC sensors is applied to an internal combustion engine having two HC sensors, this is not limitative but it goes without saying that the system may be applied to any engine having at least one HC sensor mounted therein.

What is claimed is:

1. A system for monitoring the performance of at least one HC sensor provided in an internal combustion engine having an exhaust passage, the at least one HC sensor being arranged in said exhaust passage for detecting concentration of hydrocarbons present in exhaust gases from said engine, said system comprising:

memory means for storing a value of output from said at least one HC sensor assumed when fuel supply to said engine is cut off; and correcting means for correcting a value of output from said at least one HC sensor by said value of output from said at least one HC sensor stored by said memory means to obtain a corrected value of said value of output from said at least one HC sensor.

2. A system according to claim 1, including comparison means for comparing said value of output from said at least one HC sensor assumed when fuel supply to said engine is cut off, with a predetermined value, and wherein said memory means stores said value of output from said at least one HC sensor assumed when fuel supply to said engine is cut off, if it does not exceed said predetermined value.

3. A system according to claim 2, wherein said predetermined value is set such that it cannot be exceeded by said value of output from said at least one HC sensor when fuel supply to said engine is cut off, if said at least one HC sensor is normally functioning.

4. A system according to claim 1, wherein said correcting means corrects a learned average value of output from said at least one HC sensor by said stored value.

5. A system for monitoring the performance of at least one HC sensor provided in an internal combustion engine having an exhaust passage, said at least one HC sensor being arranged in said exhaust passage for detecting concentration of hydrocarbons present in exhaust gases from said engine, said system comprising:

comparison means for comparing a value of output from said at least one HC sensor assumed when fuel supply to said engine is cut off, with a predetermined value; and judging means for judging that there is abnormality in said at least one HC sensor if said value of output from said at least one HC sensor assumed when fuel supply to said engine is cut off, exceeds said predetermined value.

6. A system according to claim 5, wherein said predetermined value is set such that it cannot be exceeded by said value of output from said at least one HC sensor when fuel supply to said engine is cut off, if said at least one HC sensor is normally functioning.

7. A system according to claim 5, wherein said judging means judges that there is abnormality in said at least one HC sensor, if said value of output from said at least one HC sensor assumed when fuel supply to said engine is cut off, has continued to exceed said predetermined value over a predetermined time period.

* * * * *